US006786186B2

(12) United States Patent
de Ojeda

(10) Patent No.: US 6,786,186 B2
(45) Date of Patent: Sep. 7, 2004

(54) UNIT TRIGGER ACTUATOR

(75) Inventor: William de Ojeda, Chicago, IL (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 0 days.

(21) Appl. No.: 10/173,483

(22) Filed: Jun. 17, 2002

(65) Prior Publication Data

US 2002/0162524 A1 Nov. 7, 2002

Related U.S. Application Data

(63) Continuation-in-part of application No. 10/044,867, filed on Jan. 10, 2002, which is a continuation-in-part of application No. 09/457,908, filed on Dec. 8, 1999, now Pat. No. 6,338,320, which is a continuation-in-part of application No. 09/152,497, filed on Sep. 9, 1998, now Pat. No. 6,044,815.

(51) Int. Cl.[7] ..... F01L 1/14

(52) U.S. Cl. ..... 123/90.55; 123/90.39; 123/90.12; 123/90.15

(58) Field of Search ..... 123/90.12, 90.15, 123/90.16, 90.18, 90.39–90.59, 320–322; 91/52, 365, 374, 378

(56) References Cited

U.S. PATENT DOCUMENTS

| | | | | |
|---|---|---|---|---|
| 2,019,970 A | | 11/1935 | Hopkins | |
| 3,661,127 A | * | 5/1972 | Cornell | 123/90.27 |
| 3,768,369 A | | 10/1973 | Knutson | |
| 4,169,449 A | | 10/1979 | Brock, Jr. | |
| 4,258,672 A | * | 3/1981 | Hietikko | 123/90.18 |
| 4,502,425 A | | 3/1985 | Wride | |
| 4,572,114 A | * | 2/1986 | Sickler | 123/21 |
| 4,656,976 A | * | 4/1987 | Rhoads | 123/90.12 |
| 4,664,070 A | * | 5/1987 | Meistrick et al. | 123/21 |
| 4,892,067 A | | 1/1990 | Paul et al. | |
| 4,901,684 A | | 2/1990 | Wride | |
| 5,002,022 A | | 3/1991 | Perr | |
| 5,012,778 A | | 5/1991 | Pitzi | |
| 5,129,373 A | * | 7/1992 | Cuatt et al. | 123/90.55 |
| 5,224,683 A | | 7/1993 | Richeson | |
| 5,248,123 A | | 9/1993 | Richeson et al. | |
| 5,287,829 A | | 2/1994 | Rose | |
| 5,339,777 A | | 8/1994 | Cannon | |
| 5,379,737 A | | 1/1995 | Hu | |
| 5,410,994 A | | 5/1995 | Schechter | |
| 5,419,301 A | | 5/1995 | Schechter | |
| 5,421,359 A | | 6/1995 | Meister et al. | |
| 5,448,973 A | | 9/1995 | Meyer | |
| 5,456,221 A | | 10/1995 | Schechter | |
| 5,456,222 A | | 10/1995 | Schechter | |
| 5,456,223 A | | 10/1995 | Miller et al. | |
| 5,462,025 A | * | 10/1995 | Israel et al. | 123/321 |
| 5,529,030 A | | 6/1996 | Rose | |
| RE35,303 E | | 7/1996 | Miller et al. | |
| 5,531,192 A | * | 7/1996 | Feucht et al. | 123/90.12 |
| 5,566,652 A | * | 10/1996 | Deppe | 123/90.35 |

(List continued on next page.)

*Primary Examiner*—Thomas Denion
*Assistant Examiner*—Jaime Corrigan
(74) *Attorney, Agent, or Firm*—Dennis Kelly Sullivan; Susan L. Lukasik; Jeffrey P. Calfa

(57) ABSTRACT

An actuator for actuating a linearly translatable member, such as an engine valve includes a unit trigger actuator, the unit trigger actuator having a trigger being electrically actuatable, a hydraulic cartridge having a selectively translatable component and being operably coupled to the trigger for receiving actuation commands therefrom, the unit trigger actuator being an open loop system. A pivot element is operably coupled to the translatable component and to the engine valve, the pivot element amplifying motion imparted to the pivot element by translatory motion of the piston at the engine valve. A lash adjuster is operably coupled to the pivot element for decoupling the hydraulic cartridge from lash inherent in a plurality of components and assembly of an engine valve arrangement. A method of actuation is further included.

24 Claims, 14 Drawing Sheets

U.S. PATENT DOCUMENTS 5,595,148 A 1/1997 Letsche et al.
5,636,602 A 6/1997 Meister
5,645,031 A * 7/1997 Meneely ..... 123/322
5,806,478 A * 9/1998 Oberg ..... 123/90.61
5,829,397 A 11/1998 Vorih et al.
5,901,676 A * 5/1999 Edelmayer ..... 123/90.35
5,964,193 A * 10/1999 Dosdall ..... 123/90.43
5,967,105 A * 10/1999 Freeland ..... 123/90.43
5,970,956 A 10/1999 Sturman
6,006,710 A * 12/1999 Stephan ..... 123/90.43
6,044,815 A 4/2000 de Ojeda
6,263,842 B1 7/2001 de Ojeda et al.
6,338,320 B1 1/2002 de Ojeda
6,439,195 B1 * 8/2002 Warner ..... 123/321
2002/0121251 A1 9/2002 Watson et al.
2003/0015155 A1 1/2003 Turner et al.

* cited by examiner

FIG. 7
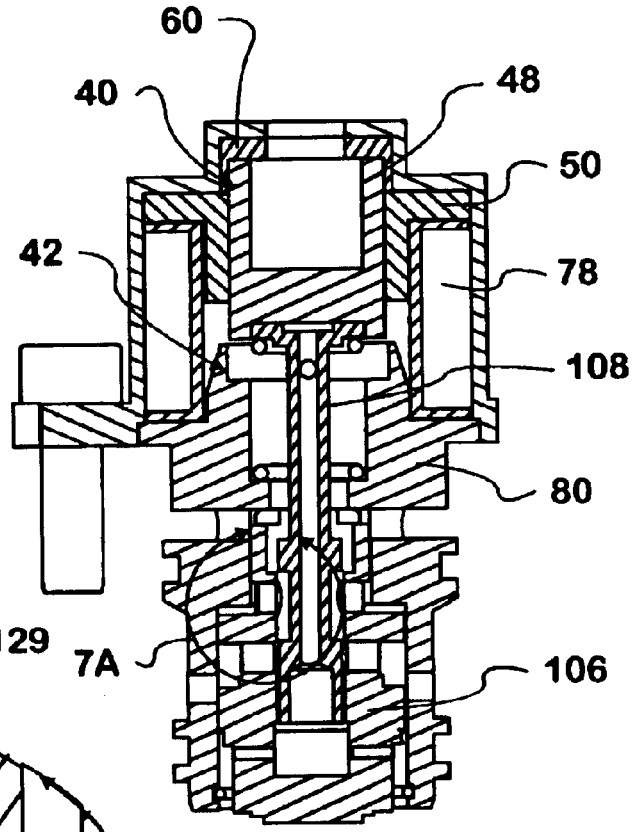
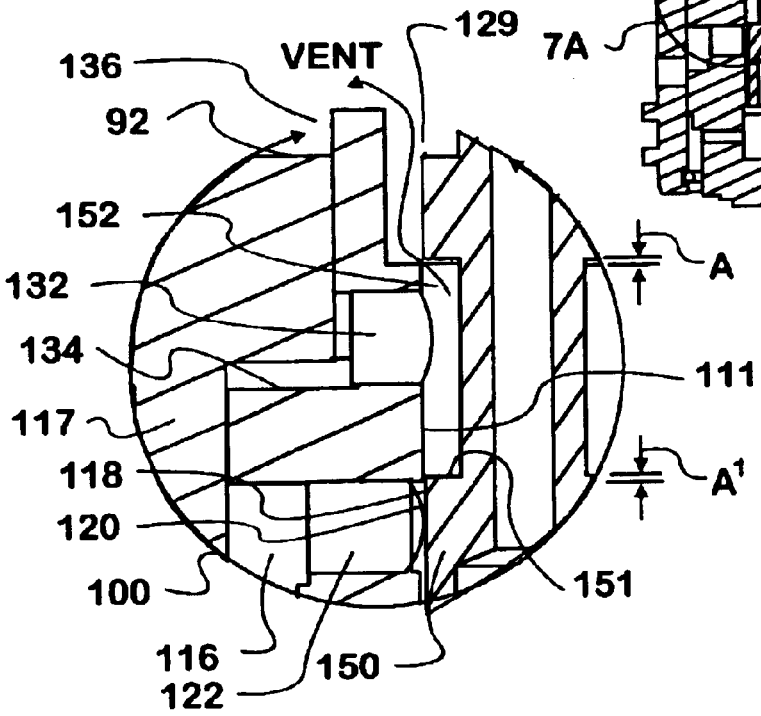
FIG. 7A

UNIT TRIGGER ACTUATOR

RELATED APPLICATIONS

This application is a continuation-in-part of U.S. patent application Ser. No. 10/044,867, filed Jan. 10, 2002, which is a continuation-in-part of U.S. patent application Ser. No. 09/457,908, filed Dec. 8, 1999, now U.S. Pat. No. 6,338,320, which is a continuation-in-part of U.S. patent application Ser. No. 09/152,497 Sep. 9, 1998, now U.S. Pat. No. 6,044,815.

TECHNICAL FIELD OF INVENTION

The present invention relates to the actuation of a linear translatable member, such as an engine valve, and, more particularly, to actuation of a camless engine valve.

BACKGROUND OF THE INVENTION

There is a need in the engine industry for greater control over the combustion process. The goal of such control is to provide for adequate power output while using fuel efficiently. In addition, unwanted emissions must be minimized, such emissions include: noxious by-products of the combustion process as well as noise. A reduction of noise emissions is particularly critical for compression ignition engines.

A way to achieve at least a portion of the control necessary to meet the afore-stated goals is by switching from cam operated engine valves to camless technology. Camless technology, at least in theory, allows direct control over dwell, the amount of valve opening (partial or full), the aggressiveness of the valve opening and closing, and other engine valve related parameters. Such control is highly advantageous in meeting the afore-mentioned goals.

Design of viable camless technology has not proven an easy task. One great concern in the viability of camless technology is the ability to control engine valve motion. Actuators that are coupled to the engine valve and that require substitution for typical cam engine valve lifts typically have required a sensor and a sophisticated feedback control system in order to control the engine valve motion. This results from the fact, that being directly coupled to the valve, requires such camless technology to account for valve lash arising from a variety of sources. Such systems have been experimented with by FEV, Siemens, Ford, Sturman, and others. Such systems demand large computer processors and the sheer size and cost of the control boards necessary for such processors have made them prohibitive both with respect to the space required proximate the engine valve, the cost of the processors themselves, and compromises to the design of internal combustion engines. The physical space proximate the engine valves for affecting engine valve motion is extremely limited, for this reason, the devices associated with camless technology need to be quite small as well as being reliable, fast, and accurate, while at the same time limiting the cost of such components.

SUMMARY OF THE INVENTION

The unit trigger actuator (UTA) of the present invention substantially meets the afore mentioned needs of the industry. The UTA relies on reducing the stroke of the actuator by a factor of between 2 and 3 while maintaining engine valve strokes comparable to cam actuation and prior art camless actuation. For these ratios, the reduced range of stroke of the UTA becomes much easier to control. Furthermore, the control may be affected without a sensor or feedback loop due to a unique means of lash control which decouples the UTA actuator from engine components. The advantage of open loop operation significantly decreases cost as well as increases reliability. Significantly, large tolerances in parts of assembly of the engine arrangement (length, variability from valve-to-valve, machining tolerances in the head in the upper and lower and firing decks, tolerance in the valve seats) become decoupled from the triggering action of the UTA. The internal parts of the UTA are decoupled from the engine parts through the play allowed in the lash adjustor. The lash adjustor further accounts for engine valve growth resulting from thermal effects.

The present invention is an actuator for actuating a linearly translatable member, such as an engine valve and includes a unit trigger actuator, the unit trigger actuator having a trigger being electrically actuatable, a hydraulic cartridge having a selectively translatable component and being operably coupled to the trigger for receiving actuation commands therefrom, the unit trigger actuator being an open loop system. A pivot element is operably coupled to the translatable component and to the engine valve, the pivot element amplifying motion imparted to the pivot element by translational motion of the piston at the engine valve. A lash adjuster is operably coupled to the pivot element for decoupling the hydraulic cartridge from lash inherent in a plurality of components and assembly of an engine valve arrangement. The present invention is further a method of actuation.

BRIEF DESCRIPTION OF THE DRAWINGS

FIG. 7 is a sectional view of the hydraulic cartridge of the UTA in the closed, venting disposition;

FIG. 7A is a sectional view of the hydraulic cartridge of the UTA taken along the section line A of FIG. 7;

DETAILED DESCRIPTION OF THE DRAWINGS

Figure 1:
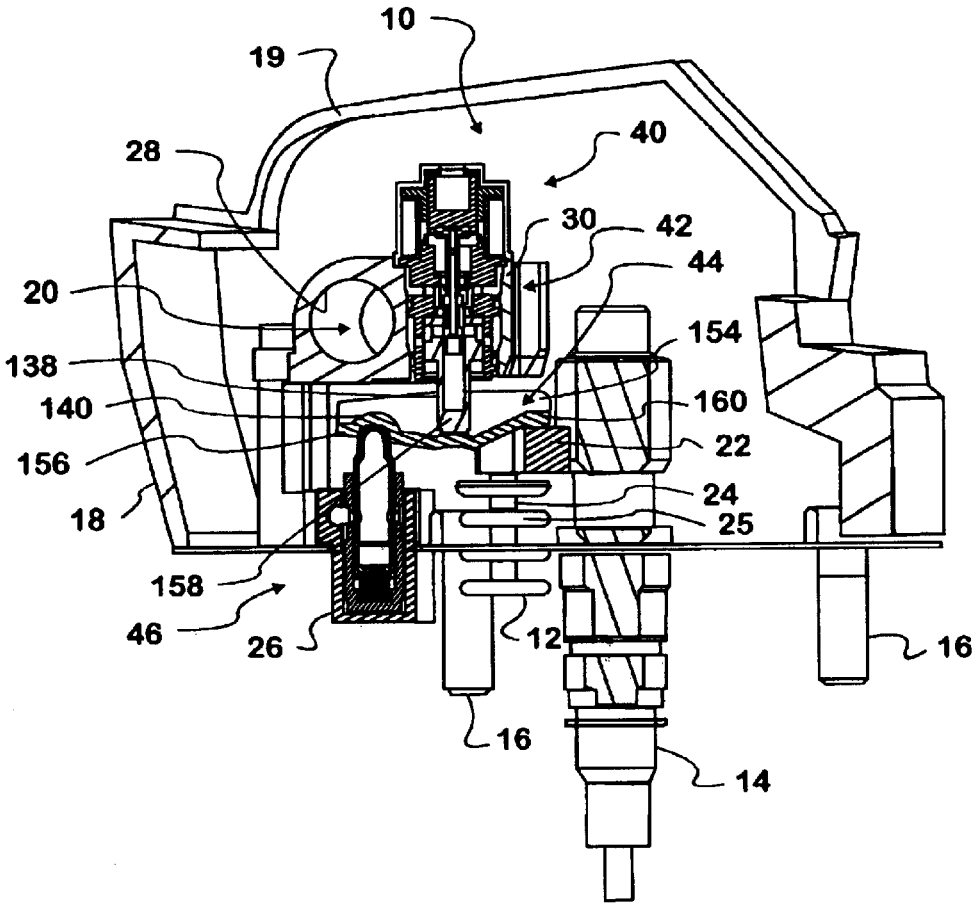
FIG. 1 is an elevational view with the UTA handrail depicted in section and disposed in the relation to other engine components in the head valve carrier.

The unit trigger actuator (UTA) of the present invention is shown generally at 10 in the drawings. Referring to FIG.

1, the UTA 10 is depicted in relationship to other engine components disposed within the head valve carrier. Such components include linearly translatable members, such as engine valve(s) 12 (see FIG. 8 for multiple engine valves 12) to be operated by the UTA 10, and the fuel injector 14 serving the same combustion chamber as the engine valve 12. Head bolts 16 couple the head valve carrier 18 to the engine head (not shown). Cover 19 spans the distance between the sidewalls of the head valve cover 18. A camless rail 20 conveying relatively high pressure actuating fluid is disposed adjacent to the UTA 10. The actuating fluid may preferably be engine lubricating oil at pressures between about 450–3,000 psi.

Figure 8:
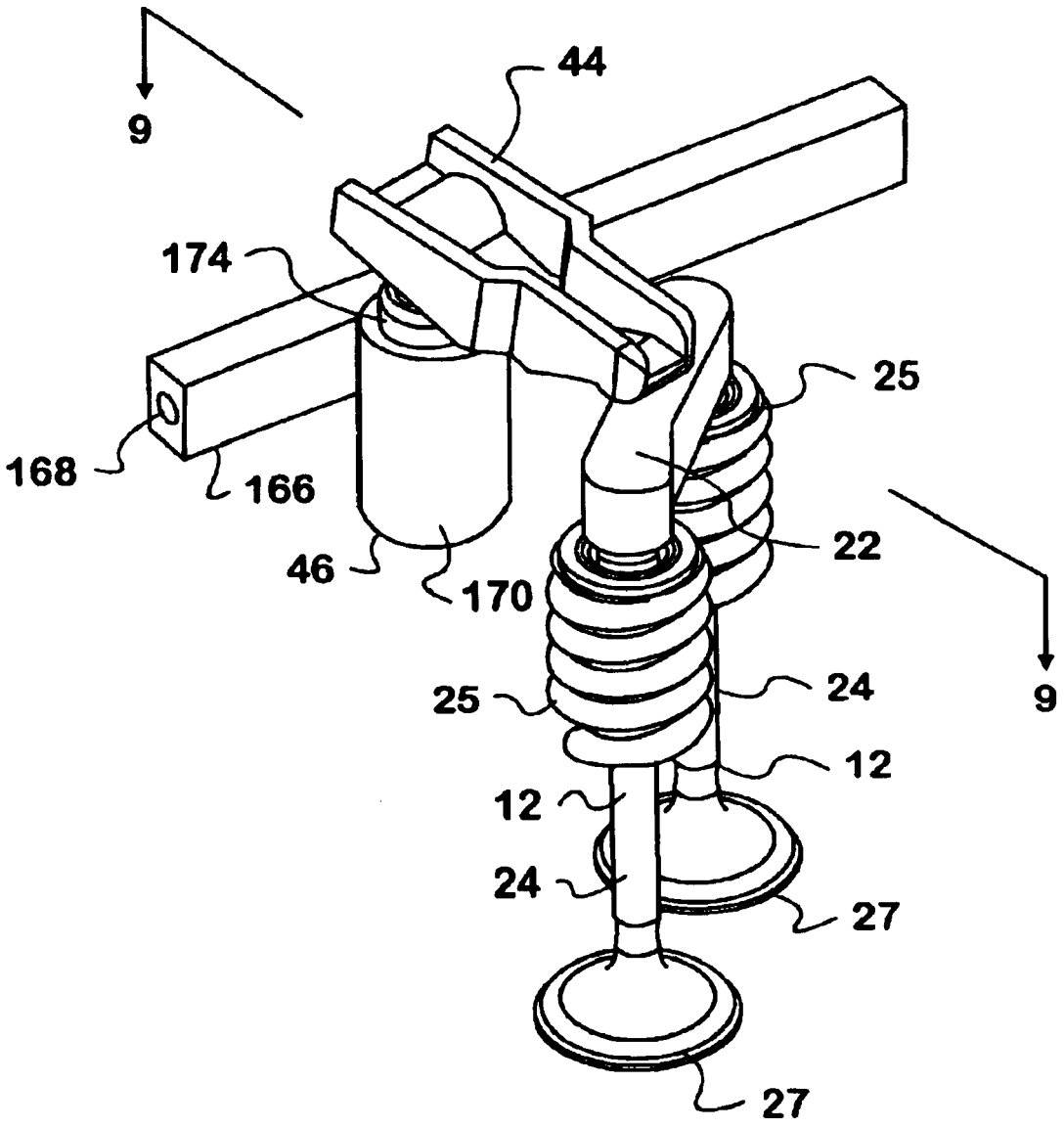
FIG. 8 is a perspective view of the UTA pivot element and lash adjuster positioned for simultaneous actuation of two engine valves.

The engine valve 12 is a conventional engine valve and may comprise either an intake or an exhaust valve. The depiction of FIG. 1 (and FIG. 8) is a four-valve head. The UTA 10 may be used with two-valve heads and other multiple valves per cylinder, such as 3 or 5 valves. In a 4-valve arrangement, the valves 12 are typically disposed symmetrically around the centrally disposed fuel injector 14. The valve 12 has an offset actuation pad 22 that is offset from the longitudinal axis of the valve stem 24. The offset actuation pad 22 is really a bridge between two engine valves 12, as depicted in FIG. 8, for the simultaneous actuation of the two engine valves 12. For single engine valve 12 actuation, the actuating force is preferably applied coaxial with the valve stem 24. The valve spring 25 is disposed concentric with the valve stem 24. The valve face 27 (see FIGS. 8 and 9) depends from the valve stem 24 and forms a portion of the upper margin of the combustion chamber when in the closed disposition. The UTA 10 can additionally be utilized with an engine valve in which the valve seat is moveable relative to a fixed valve.

The injector 14 may be any type of injector in current usage. Such injectors include those serviced by a high-pressure fuel rail of such as produced by Robert Bosch, and hydraulically-actuated, electronically-controlled unit injectors (HEUI). HEUI injectors are serviced by a high pressure actuating fluid rail. In the preferred embodiment of the present invention, the camless rail 20 serves this function. In the embodiment depicted in FIG. 1, the camless rail 20 is configured such that it supplies high pressure actuating fluid both to the UTA 10 and to the injector 14, when the injector 14 is the HEUI type injector.

The head valve carrier 18 is a generally U-shaped in section and preferably extends across an entire bank of cylinders. In the preferred embodiment, the head valve carrier 18 includes a depending well 26. A cover 19 encloses the engine components residing within the head valve carrier 18, providing a seal for the head valve carrier 18.

The camless rail 20 is preferably an elongate rail extending across an entire bank of cylinders. The rail 20 is typically in fluid communication with a high pressure pump (not shown) that supplies actuating fluid to the rail 20. Preferably, the actuating fluid is engine oil at an elevated pressure of about 450 to 3,000 psi. Other actuating fluids can be used, including engine fuel. The rail 20 has an elongate substantially cylindrical accumulator 28 for providing actuating fluid to both the UTA 10 and to HEUI type injectors 14. An integral UTA receiver 30 is formed as a portion of the rail 20 in the embodiment of FIGS. 1 and 2. As noted in FIG. 2, the rail 20 includes a second integral UTA receiver 30 for housing the UTA 10 associated with the second set of engine valves 12 (one set being intake valves and the other set being exhaust valves) associated with an adjacent combustion chamber.

The UTA 10 of the present invention includes four major components; solenoid (or trigger) 40, hydraulic cartridge 42, pivot element 44 and lash adjustor 46. It should be noted that reference may be made to U.S. Pat. Nos. 6,044,815 and 6,263,842 for further understanding of the operation of the solenoid 40 and the hydraulic cartridge 42. Such patents are assigned to the Assignee of the present application and are incorporated herein by reference.

Figure 3:
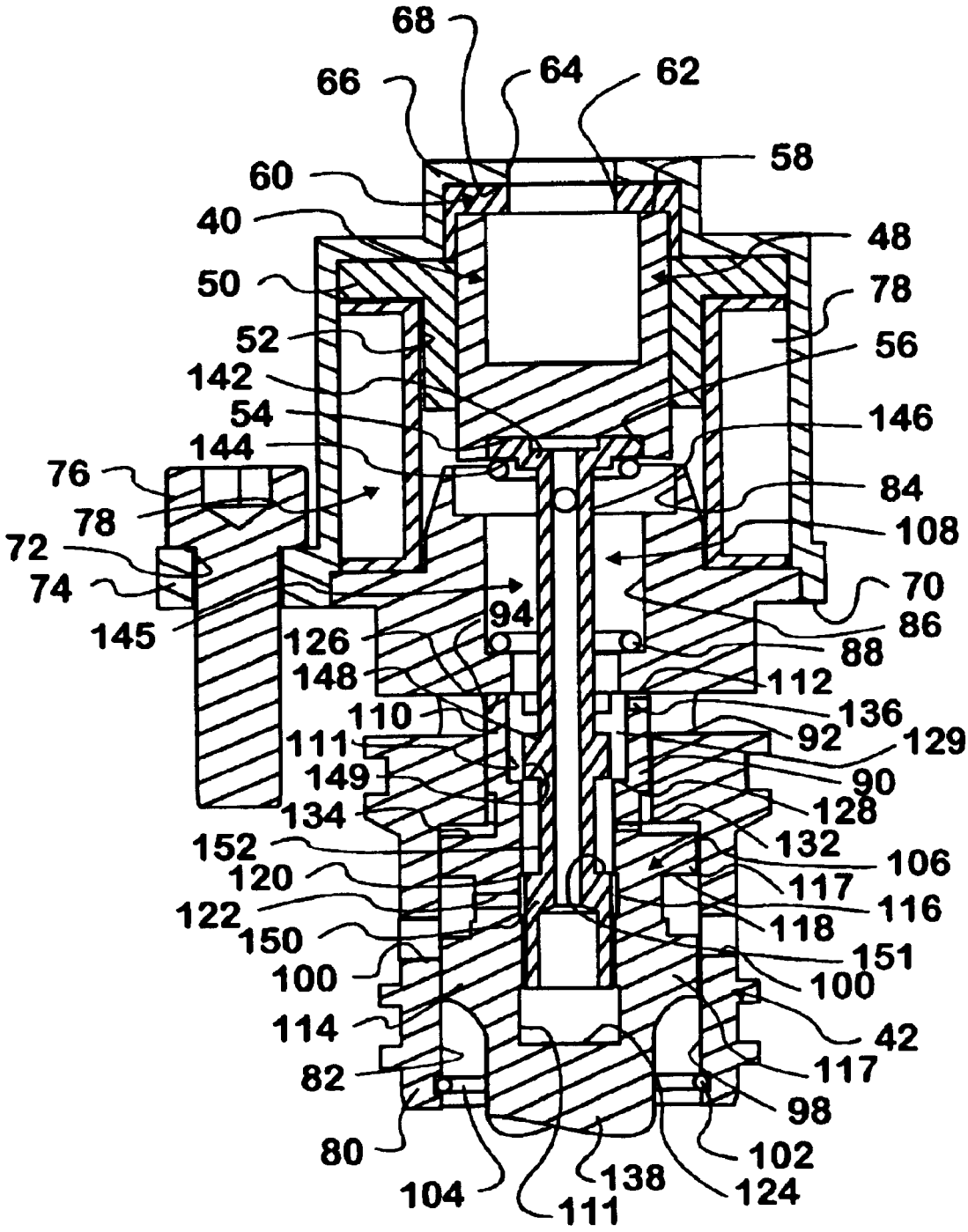
FIG. 3 is a sectional, elevational view of the UTA cartridge.
Figure 4:
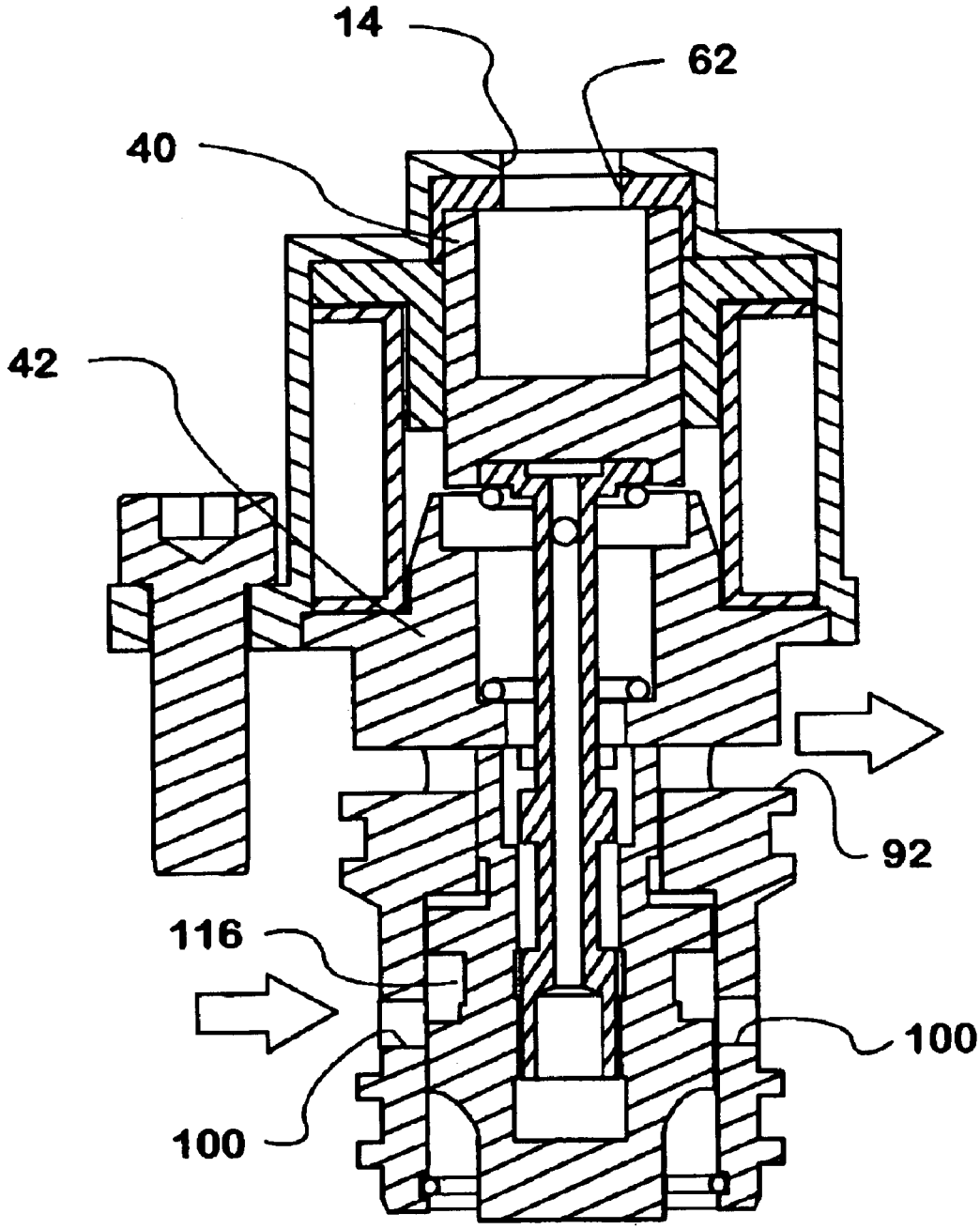
FIG. 4 is the view of the UTA as depicted in FIG. 3 including actuating fluid flow.
Figure 5:
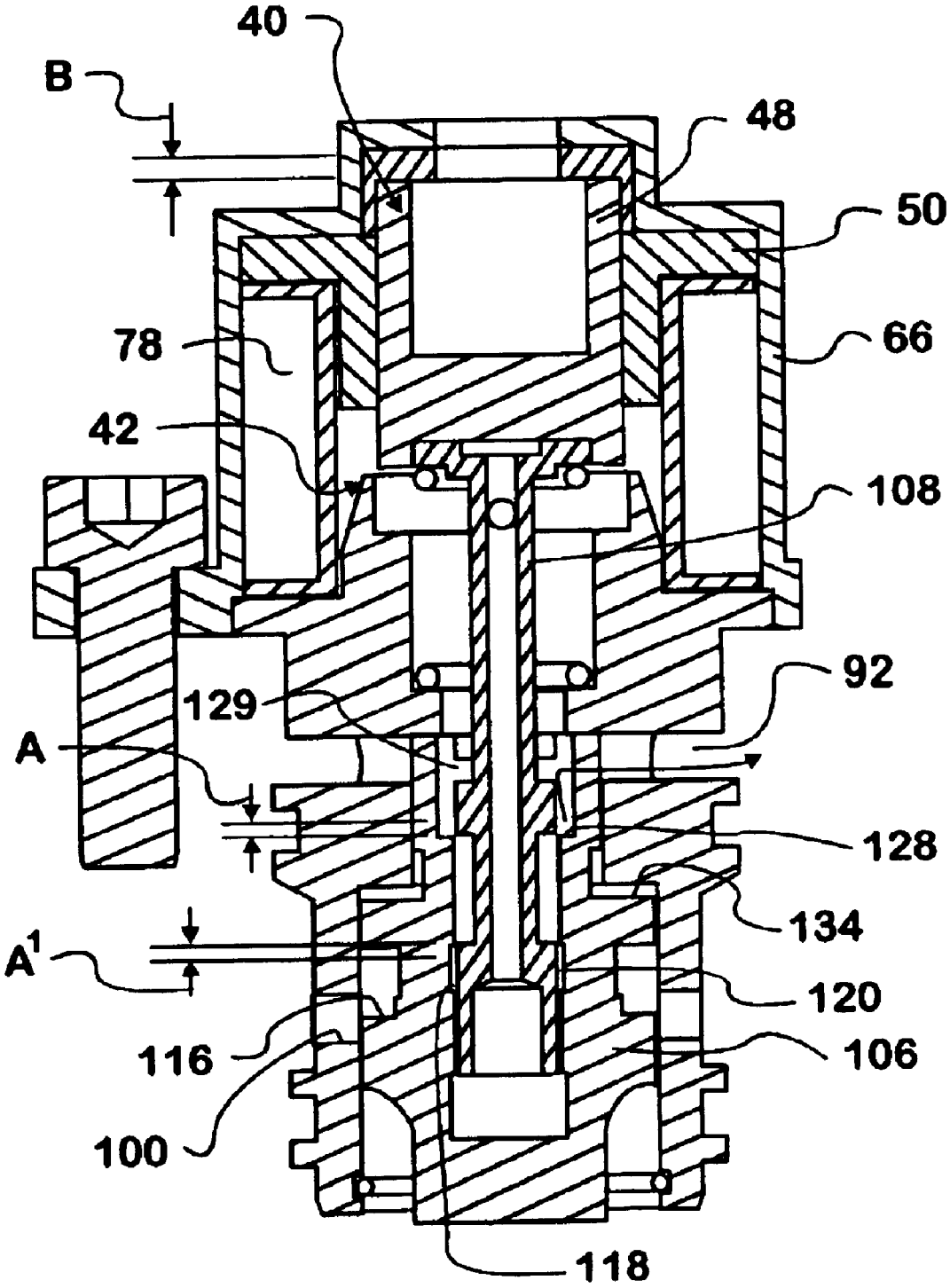
FIG. 5 is a sectional view of the UTA of the present invention depicting the opening and overlap lengths.

The first component of the UTA 10 is the solenoid 40. Reference may be had to FIGS. 3–5 for the following discussion. The solenoid 40 includes an armature 48 that is translatably disposed within an armature guide 50. The armature guide 50 provides a cylindrical surface that is coincident with at least a portion of the outside margin of the armature 48 and constrains the armature 48 during translation thereof. Accordingly, the cylindrical surface of the armature guide 50 comprises a guide bore 52.

A needle bearing surface 54 comprises a portion of the bottom margin of the armature 48. The needle bearing surface 54 resides within a recess 56 defined in the bottom surface margin of the armature 48.

The upper margin 58 of the armature 48 comprises an armature stop. The upper margin 58 is stopped by a shim 60 when the armature 48 is in the retracted disposition. The shim 60 has a selected depth dimension B, as will be described in greater detail below with reference to FIG. 5.

A hydraulic vent 62 is defined in the shim 60. The hydraulic vent 62 is preferably in registry with a hydraulic vent 64 defined in the cover 66. The underside margin 68 of the top of the cover 66 constrains the shim 60 between the cover 66 and the upper margin 58 of the armature 48.

The cover 66 further has retaining groove 70 that is formed proximate the lower margin of the cover 66. The retaining groove 70 bears on a peripheral margin of the cartridge 42. A bore 72 is defined in a flange 74 that projects to the side of the cover 66. A bolt 76 may be passed through the bore 72 and threaded into a threaded bore defined in the rail 20. By such means, the cover 66 secures both the solenoid 40 and the cartridge 42 in the integral UTA receiver 30 defined in the rail 20 and holds the shim 60 in place.

The cover 66 additionally provides a retaining element for the coil 78 that is associated with the armature 48. The coil 78 is generally cylindrical in shape and resides outward of the armature 48. The armature guide 50 is preferably disposed between the coil 78 and the armature 48. Suitable electrical leads (not shown) couple the coil 78 to an external controller (not shown) for providing actuation commands to the UTA 10.

The second component of the UTA 10 is the hydraulic cartridge 42. The hydraulic cartridge 42 includes a cartridge body 80. An actuator bore 82 is centrally defined within the cartridge body 80. The actuator bore 82 extends all the way through the cartridge body 80 and has a number of varying diameters. Commencing at the top margin of the cartridge body 80, the first such diameter defines an armature receiver 84. When the armature 48 is in the actuated, extended disposition, the armature 48 translates downward from the retracted disposition of FIG. 1A to the extended disposition of FIG. 1B and is encompassed in part by the armature receiver 84.

The portion of the actuator bore 82 immediately below the armature receiver 84 has a lesser diameter than the armature receiver 84 and comprises a spring cage 86. A step formed at the bottom margin of the spring cage 86 comprises a spring seat 88.

A portion of the actuator bore 82 that comprises a piston neck receiver 90 is beneath the spring cage 86 and has a diameter that is greater than the step forming the spring seat 88. A hydraulic vent 92 extends radially outward from the piston neck receiver 90 and fluidly connects the piston neck receiver 90 to ambient conditions exterior to the hydraulic cartridge 42 (see in particular FIG. 4). A piston stop 94 is formed at the upper margin of the piston neck receiver 90. Preferably, the piston stop 94 is formed by the step that also forms the spring seat 88, the stop 94 being the lower margin of the step and the seat 88 being the upper margin of the step.

The greatest diameter of the actuator bore 82 comprises the lowermost portion of the actuator bore 82. This portion defines a power section receiver 98. A hydraulic inlet 100 extends through the cartridge body 80 and fluidly couples the power section receiver 98 to actuating fluid under pressure provided by the rail 20. See in particular FIG. 4. A retainer groove 102 is defined in the power section receiver 98 proximate the lower margin of the cartridge body 80. A retainer 104, preferably a snap ring, may be disposed in the retainer groove 102.

A piston 106 and a needle (sometimes referred to as a spool) 108 reside within the actuator bore 82 and are retained in place by the retainer 104.

The piston 106 is preferably a unitary device having a generally cylindrical outside margin of varying diameters. The piston 106 has, in descending order as depicted, a neck 110, a power section 114, and an actuator rod 138. A blind needle bore 111 is centrally defined within the piston 106 and extends downward to approximately the juncture of the power section 114 and the actuator rod 138. The needle bore 111, being blind, is closed at the bottom 124. The needle bore 111 is open at a top opening 126 formed by an upper margin 112.

The neck 110 of the piston 106 preferably translatably resides within the piston neck receiver 90 of the cartridge body 80. When the piston 106 is in the retracted, venting disposition (see FIGS. 7 and 7*a*), the upper margin 112 of the neck 110 is stopped by the piston stop 94 defined in the actuator bore 82 of the cartridge body 80.

The power section 114 of the piston 106 has an annular groove 116 defined between a pair of spaced apart lands 117. The annular groove 116 is preferably in registry with the hydraulic inlet 100 and, accordingly, is in fluid communication with actuating fluid provided by the rail 20. An annulus 118 is defined in the needle bore 111 substantially in registry with the annular groove 116. A fluid passageway 122 fluidly connects the annular groove 116 to the annulus 118. As noted in more detail below, the upper margin 120 of the annulus 118 becomes a critical interface in the operation of the piston 106 and needle 108.

A second critical interface of the piston 106 and needle 108 is the sealing shoulder 128. Sealing shoulder 128 is formed by a step increase in the diameter of the needle bore 111. The increase in diameter of the needle bore 111 forms an annulus 129 that is at least in part in registry with the hydraulic vent 92 defined in the cartridge body 80.

A high pressure fluid passageway 132 extends between the needle bore 111 and a piston head 134. A vent passageway 136 extends between the annulus 129 formed by the increased diameter of the needle bore 111 upward up the step 128 and the vent 92.

Figure 1B:
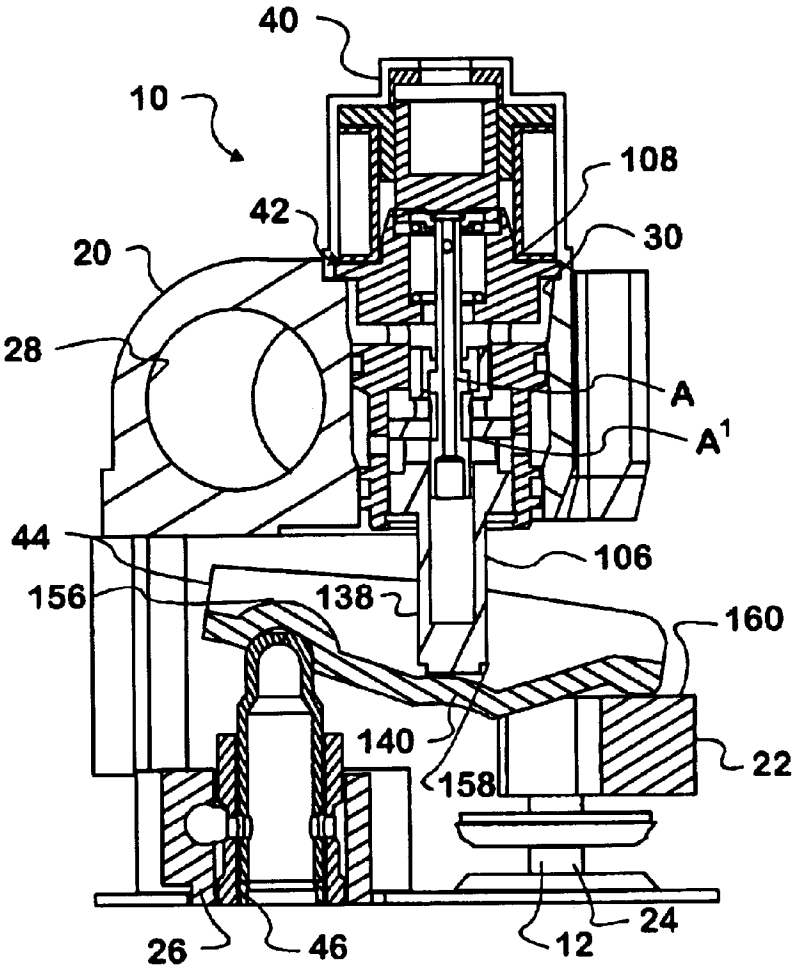
FIG. 1B is a depiction of the UTA of FIG. 1 in the extended (engine valve open) disposition.
Figure 1A:
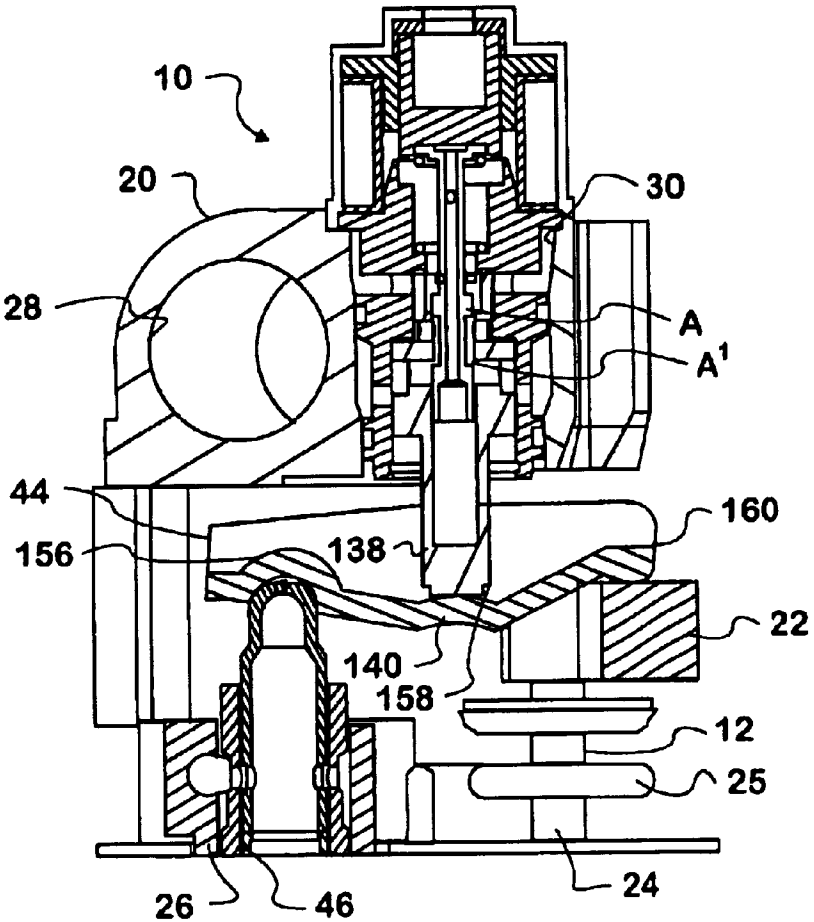
FIG. 1A is a depiction of the UTA of FIG. 1 in the retracted (engine valve closed) disposition.

The actuator rod 138 depends from the power section 114, as depicted in FIGS. 1–1B. The distal end 140 of the actuator rod 138 bears on the pivot element 44.

The needle (spool) 108 is operably coupled to the armature 48 of the solenoid 40 and is translatably disposed within the needle bore 111 of the piston 106. The needle 108 has a head 142 that bears on the needle bearing surface 54 defined within the recess 56 of the armature 48. The underside margin of the head 142 comprises a spring seat 144. A coil return spring 145 is captured between the spring seat 144 and the spring seat 88 formed at the bottom of the spring cage 86 defined in the cartridge body 80. The return spring 145 is generally always in a state of compression and exerts an upward bias on the needle 108.

The return spring 145 is disposed concentric with a shank 146 that depends from the head 142. The shank 146 has a spool groove 152 defined between an upper land 148 and a lower land 150. As described in greater detail below, the positional interaction between the lower margin 149 of the upper land 148 and the sealing shoulder 128 and upper margin 151 of the lower land 150 with the upper margin 120 of the annulus 118 is critical to the operation of the piston 106 and needle 108.

The third component of the UTA 10 is the pivot element 44 (see FIGS. 1-2 and 8-10). The pivot element 44 is comprised of an arm 154. Unlike a conventional rocker arm which is anchored at and pivots about a generally central pivot point, the arm 154 is captured between three points and during operation of the arm 154 translational (rotational) motion occurs at all three points of capture at various stages of the operation. The first point of capture is the cup 156, at which the lash adjustor 46 is operably coupled to the arm 154. The second point of capture is the rod bearing point 158 at which the distal end 140 of the actuator rod 138 bears on the arm 154. The third point of capture is the valve bearing point 160, at which the arm 154 is operably coupled to the offset actuation pad 22 of the engine valve(s) 12.

The fourth component of the UTA 10 is the lash adjustor 46. See in particular FIGS. 8–10. The lash adjustor 46 resides in the well 26 of the head valve carrier 18. The lash adjustor 46 is in fluid communication with a low pressure actuating fluid rail 166. The rail 166 has an internal accumulator 168 for conveying an actuating fluid under pressure. The actuating fluid is preferably engine oil at engine lubricating pressure, typically at a pressure on the order of 50 psi.

The lash adjuster 46 has three major subcomponents; cylinder housing 170, piston 172, and check valve assembly 174. The cylinder housing 170 is generally cylindrical in shape and has a cylinder 176 defined interior to the housing 170 by cylinder wall 177. The cylinder 176 is blind, having a closed bottom 178 and a top opening 180. An annulus 182 is defined in the outer margin of the cylinder housing 170. The annulus 182 is in fluid communication with the accumulator 168. An actuating fluid inlet 184 fluidly connects the annulus 182 and the cylinder 176.

The second subcomponent of the lash adjuster 46 is piston 172. The piston 172 is translatably disposed in the cylinder 176 defined in the cylinder housing 170. The piston 172 has a piston wall 186 defining an interior fluid cavity 188. The fluid cavity 188 has a bottom opening 190 that is peripherally defined by the bottom margin 192 of the piston wall 186.

The piston 172 further has a domed top margin 194 that is dimensioned to rotatably reside in the cup 156 of the pivot element 44. A lubricating port 196 is defined in the domed top margin 194 to accommodate an outward directed flow of lubricating fluid to lubricate the interface between the domed top margin 194 and the cup 156.

An inlet port 198 is defined extending through the piston wall 186. The inlet port 198 is in registry with the actuating fluid inlet 184 of the cylinder housing 170. Although the piston 172 translates within the cylinder 176, the range of such translation is limited such that the inlet port 198 is always in registry with the actuating fluid inlet 184 and accordingly, the fluid cavity 188 is always in fluid communication with the accumulator 168 of the low pressure actuating fluid rail 166.

The third subcomponent of the lash adjustor 46 is the check valve assembly 174. The check valve assembly 174 includes an actuator 200. The actuator 200 is translatably disposed within the cylinder 176 of the cylinder housing 170. The actuator 200 has an actuator wall 202 defining an interior fluid cavity 204. The actuator wall 202 has an outer margin 205 spaced very slightly apart from the cylinder 176 to define an annulus 207 of known dimensions between the outer margin 205 and the cylinder 176.

The fluid cavity 204 has a top opening 206 that is peripherally defined by the top margin 208 of the actuator wall 202. An orifice 210 is preferably centrally defined within the bottom margin 211 of the actuator wall 202.

A chamfered ball valve seat 212 is in fluid communication with the orifice 210 and extends downward and outward from the orifice 210. A ball valve 214 is shiftably disposed proximate the ball valve seat 212. The ball valve 214 is retained in place by a cage 216. The cage 216 is perforated to permit the passage of actuating fluid therethrough. Accordingly, when the ball valve 214 is in the open disposition off the valve seat 212, actuating fluid is free to pass through the orifice 210 around the ball valve 214 and out through the cage 216.

A spring 218 is captured within a spring well 220. The upper margin of the spring 218 bears on the underside of the actuator 200. The spring 218 is always in a compressed state and accordingly exerts an upward directed bias on the actuator 200. The actuator 200 transmits this bias to the piston 172 since the top margin 208 of the actuator 200 bears on the bottom margin 192 of the piston 172. As will be detailed below, the spring well 220 is flooded with actuating fluid. Under compression of the piston 172 and actuator 200, a known quantity of actuating fluid is vented from the spring well 220 through the annulus 207.

In assembly, the needle 108 is positioned relative to the piston 106 as depicted in FIG. 5. In the retracted disposition of FIGS. 1*a*, 7, and 7*a*, the lower margin 149 of the upper land 148 is spaced apart from the ceiling shoulder 128 the distance A, as depicted in FIG. 5. Likewise, the upper margin 151 of the spool groove 152 is displaced above (overlapping) the upper margin 120 of the annulus 118, thereby sealing off the annulus 118 and the inflow of high pressure actuating fluid. The amount of overlap is indicated by the distance A' in FIG. 5. The distances A, A' are preferably equal.

Figure 6:
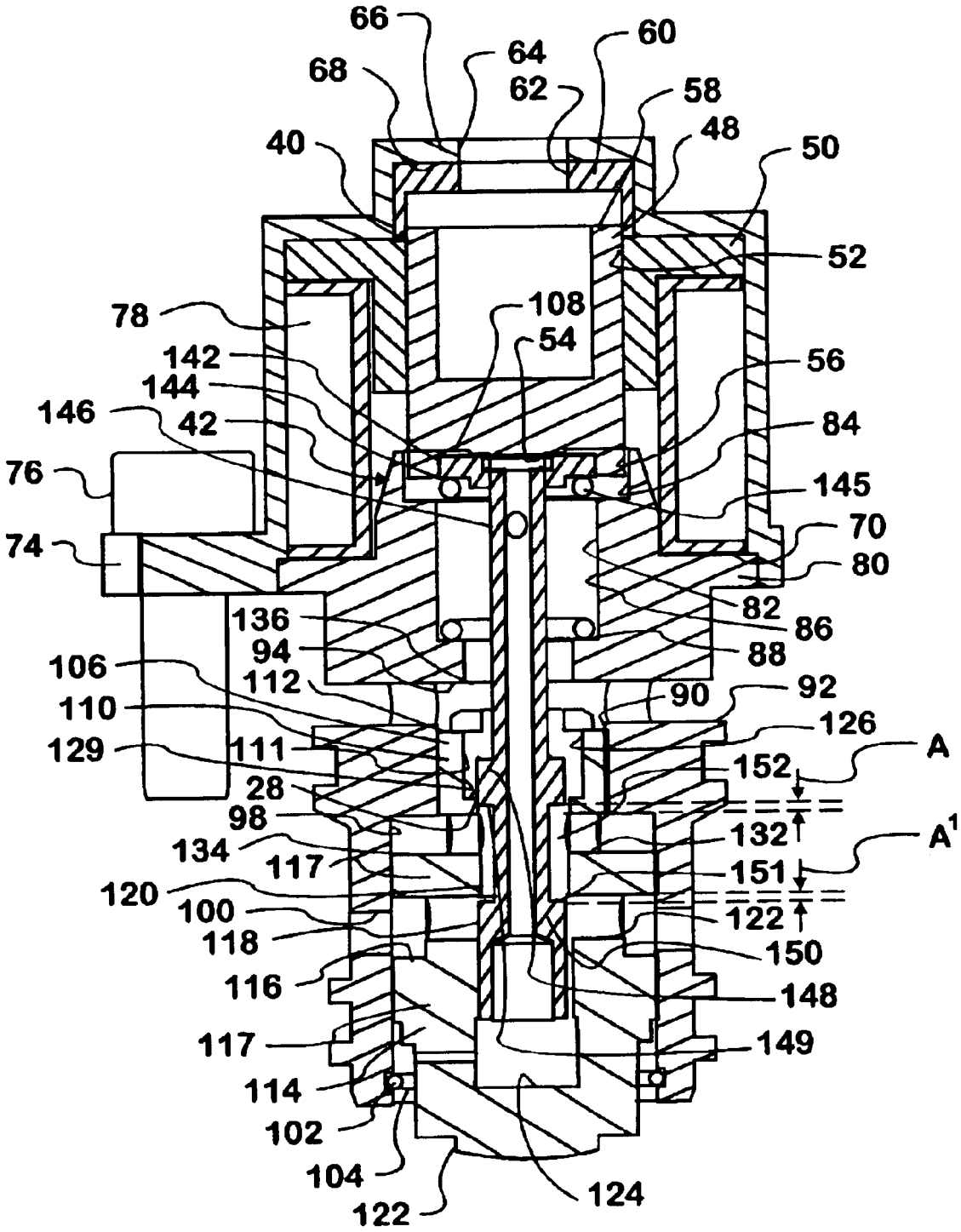
FIG. 6 is a sectional view of the hydraulic cartridge of the UTA in the open, stroking disposition.
Figure 6A:
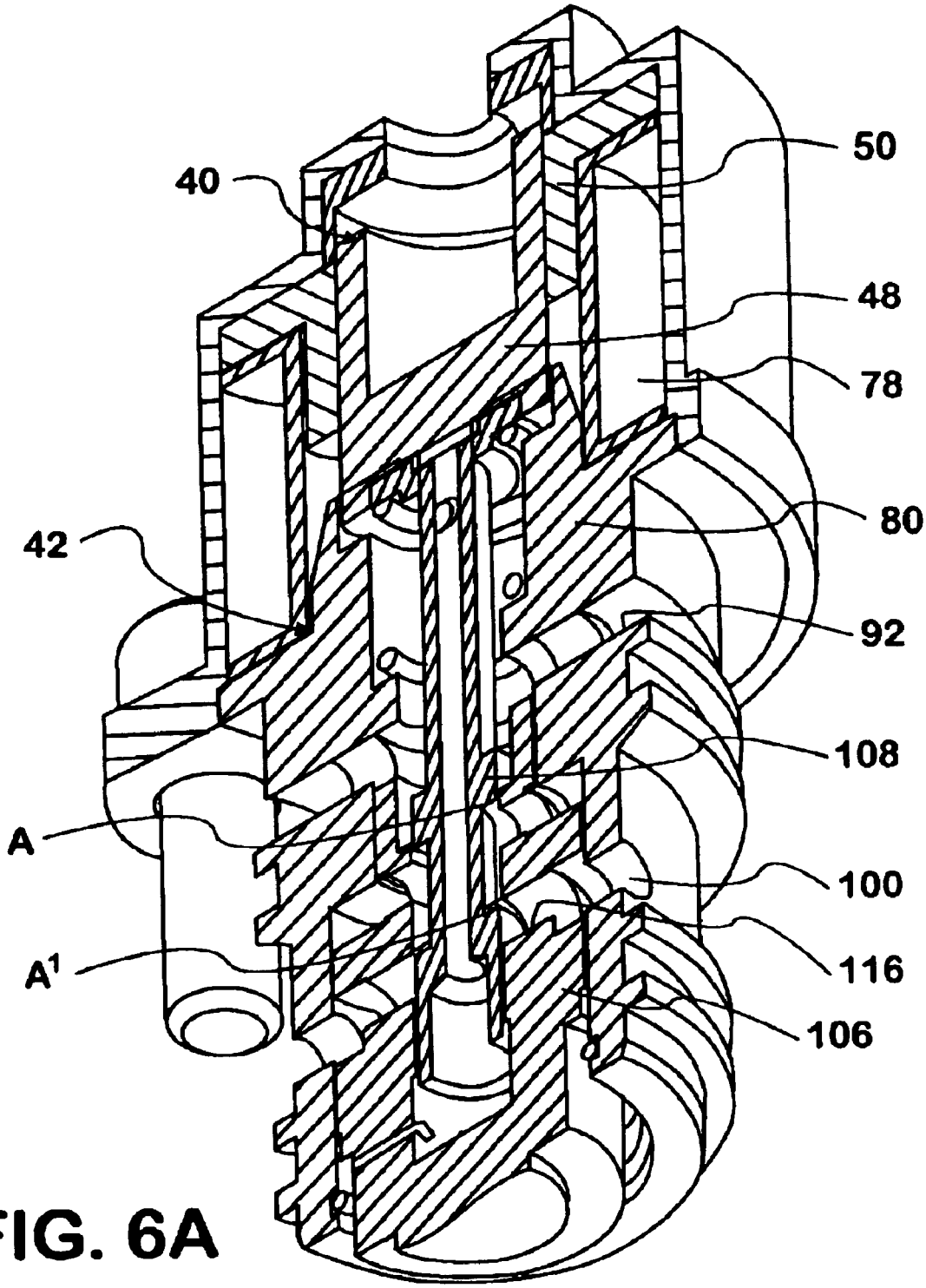
FIG. 6A is a perspective sectional view of the hydraulic cartridge of the UTA in the open, stroking disposition.

When the hydraulic cartridge 42 and solenoid 40 are assembled, the shim 60 is interposed under the cover 66 bearing on the upper margin 58 of the armature 48, the thickness of the shim 60 is noted by the dimension B in FIG. 5 and this thickness sets the amount of the opening A and the overlap A' as noted above. Significantly, the amount of the opening A and the overlap A' (in the retracted disposition) remains constant throughout the operation of the UTA 10. This is the case because the solenoid 40 and hydraulic cartridge 42 are decoupled from the lash inherent in the various engine components, as noted below. Preferably, the dimension A, A' is between 0.4 and 1.2 mm and is preferably about 0.7 mm. The range of motion of the needle 108 is preferably between 3.0 and 4.5 mm. The range of motion of the piston 106 is between about 2.5 mm and 3.5 mm. Most preferably, the needle 108 moves 3.7 mm and the piston 106 moves 3.0 mm, the difference being the dimension A, A'. The ratio of engine valve 12 movement to piston 106 movement is between 1.5 to 1 and 3.5 to 1. Most preferably, the ratio is 2.2 to 1, which yields a range of motion for the engine valve 12 of 6.6 mm. It should be noted that in the extended open disposition depicted in FIG. 6, the dimension A becomes an overlap and dimension A' becomes an opening, as fixed by the dimension B of the shim 60.

In operation, the large tolerances in parts in assembly in the engine valve arrangement (length variability from valve-to-valve, machining tolerances in the head in the upper and lower firing decks, tolerance in the valve seats, etc.) are decoupled from the triggering action of the UTA 10. That is, the internal components of the solenoid 40 and hydraulic cartridge 42 are decoupled from the lash inherent engine components through the play allowed by the lash adjustor 46.

When the engine valve 12 is in a rest or closed position, the lash adjustor 46 exerts an upward bias on the pivot element 44, lifting the pivot element 44 so that the piston 106 and needle 108 are fully retracted as depicted in FIGS. 5, 7, and 7*a*. The amount of lift in the lash adjustor 46 varies according to the relative position of the engine valve 12 and the actuators (piston 106 and needle 108) of the UTA 10. The operation of the lash adjustor 46 (described in greater detail below) relies on continuously leaking a small amount of oil through annulus 207 (FIGS. 9 and 10) during movement of the engine valve 12 and refilling the lash adjustor 46 when the engine valve 12 is seated (closed). This refilling of the lash adjustor 46 causes the lash adjustor 46 to refit (continuously adjust) the lifting bias on the pivot element 44, thereby nulling out the lash inherent in the engine components. During the opening and closing movements of the engine valve 12, oil in the lash adjustor 46 is "hydraulically locked". This is affected by means of the bail valve 214 that checks the outward flow of oil from the lash adjustor 46 when pressure exerted by the pivot element 44 on the lash adjustor 46 exceeds a certain level. Refill of engine oil to the lash adjustor 46 occurs through the check valve 124 in the lash adjustor 46 during periods of time when the engine valve 12 is retracted (seated).

When the trigger (solenoid 40) actuates the spool (needle 108) in the UTA 10, the engine valve 12 is shifted from the closed (seated) disposition to the open disposition. The only delay in actuation of the engine valve 12 between the time of actuation of the solenoid 40 and movement of the engine valve 12 is the amount time the it takes the needle 108 to translate through the dimension A, A' noted in FIG. 5.

Prior to actuation of the solenoid 40, the piston 106 and needle 108 are in their retracted dispositions as indicated in FIG. 5. The incoming high-pressure actuation fluid is sealed off where the overlap is indicated by the dimension A'. The spool 152 is opened as indicated by the dimension A and actuating fluid is free to flow from the spool 152 upward through the vent passageway 136 and out the hydraulic vent 92. See also FIG. 4.

Upon actuation of the solenoid 40, the armature 48 is drawn downward by the magnetic force generated in the coil 78, overcoming the bias of the return spring 145. The armature 48 carries with it the needle 108. The needle 108 translates downward relative to the piston 106. Such motion closes the opening indicated by dimension A, thereby sealing off the venting of actuating fluid. Simultaneously, the overlap indicated by dimension A' is eliminated, thereby opening the spool 152 to the annulus 118 and causing the flow of high pressure actuating fluid into the spool 152, as depicted in FIGS. 4–6*a*. The high pressure actuating fluid flows radially outward through high-pressure fluid passageway 132 to bear downward on the piston head 134.

The force generated by the high pressure actuating fluid acting on the piston head 134 drives the piston 106 downward (in conjunction with the continued downward travel of the spool 108). This downward translation of the piston 106 exerts a downward pressure on the pivot element 44. Such pressure acts to hydraulically lock the lash adjustor 46. By hydraulically locking the lash adjustor 46, the point of contact of the upper margin 194 of the piston 172 of the lash adjustor 46 in the cup 156 becomes a pivot point for the pivot element 44. Further downward translation of the piston 106 (it should be noted that the needle 108 continues to translate downward in conjunction with the piston 106) causes the pivot element 44 to rotate about the cup 156 thereby exerting a downward force on the offset actuation pad 22 of the engine valve 12. This force is sufficient to overcome the opposing bias of the valve spring 25 and results in an opening translation of the engine valve 12. The distance between the rod bearing point 158 and the valve bearing point 160 on the pivot element 44 results in amplification of the downward translational motion of the piston 106. As noted above, the ratio of engine valve 12 movement to piston 106 movement is most preferably 2.2 to 1. Accordingly, in the embodiment depicted, the engine valve 12 motion between the closed disposition and the open disposition is approximately 6.6 mm.

Retraction or closing of the valve 12 occurs when the actuation command to the solenoid 40 is withdrawn. The magnetic field collapses and the return spring 145 shifts the needle 108 upward relative to the piston 108 to the retracted venting disposition depicted in FIGS. 4, 5, 7, and 7*a*. The accumulator 168 of rail 20 is sealed off from the hydraulic cartridge 42 by the overlap A' of FIG. 5. Hydraulic fluid in the hydraulic cartridge 42 escapes through opening A and out hydraulic vent 92, as depicted in FIG. 4. Return spring 25 of engine valve 12 returns engine valve 12 to the closed disposition. The pivot element 44 is pivoted about the interface at the cup 156 and an upward force is exerted on the actuator rod 138 at the rod bearing point 158. The piston 106 and needle 108 are carried upward with the closing engine valve 12 until the engine valve 12 is seated. Seating of the engine valve 12 occurs just shy of the fully retracted disposition of the piston 106 and needle 108.

Figure 9:
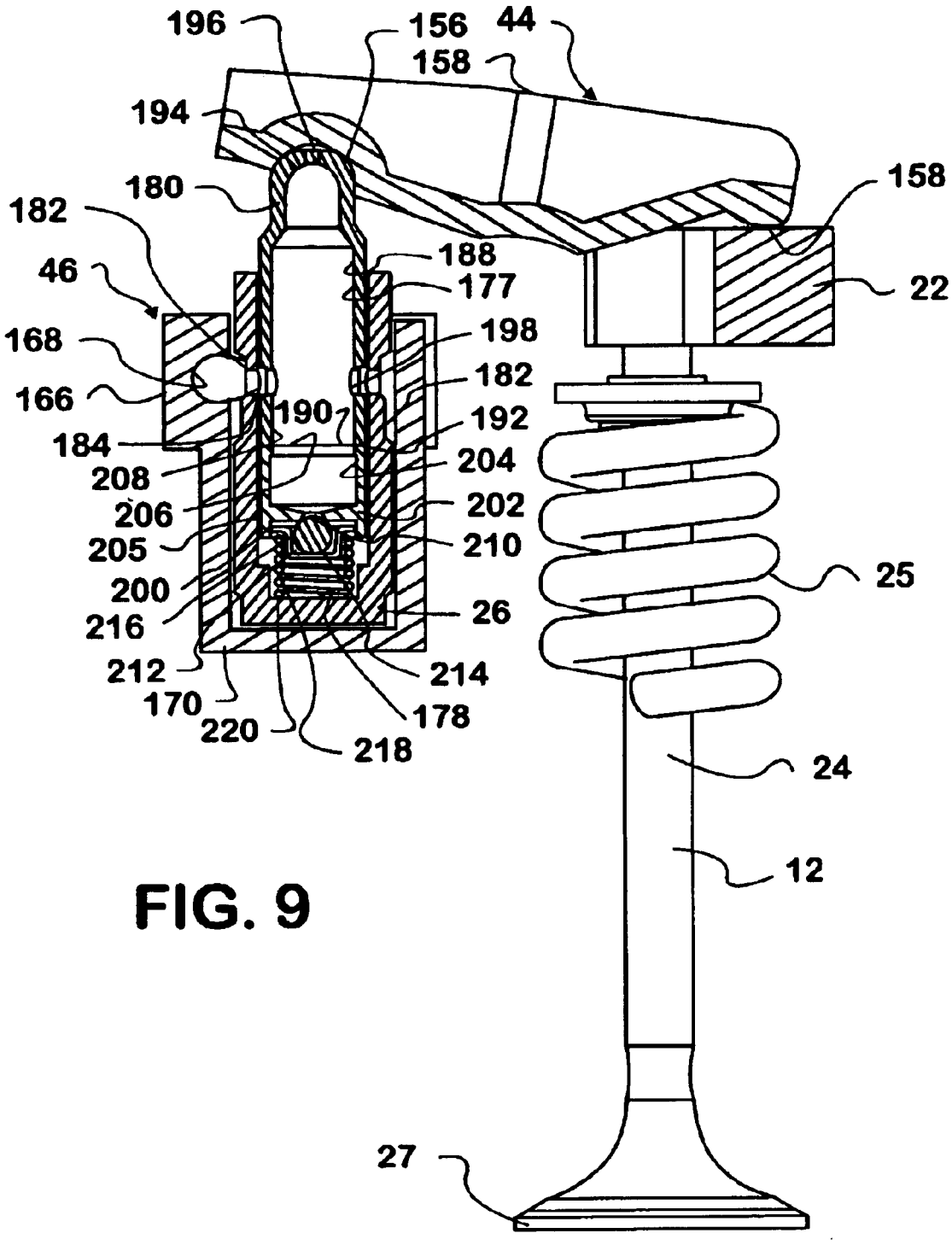
FIG. 9 is a sectional view of the UTA pivot element and lash adjuster taken along the section line 9—9 of FIG. 8.
Figure 10:
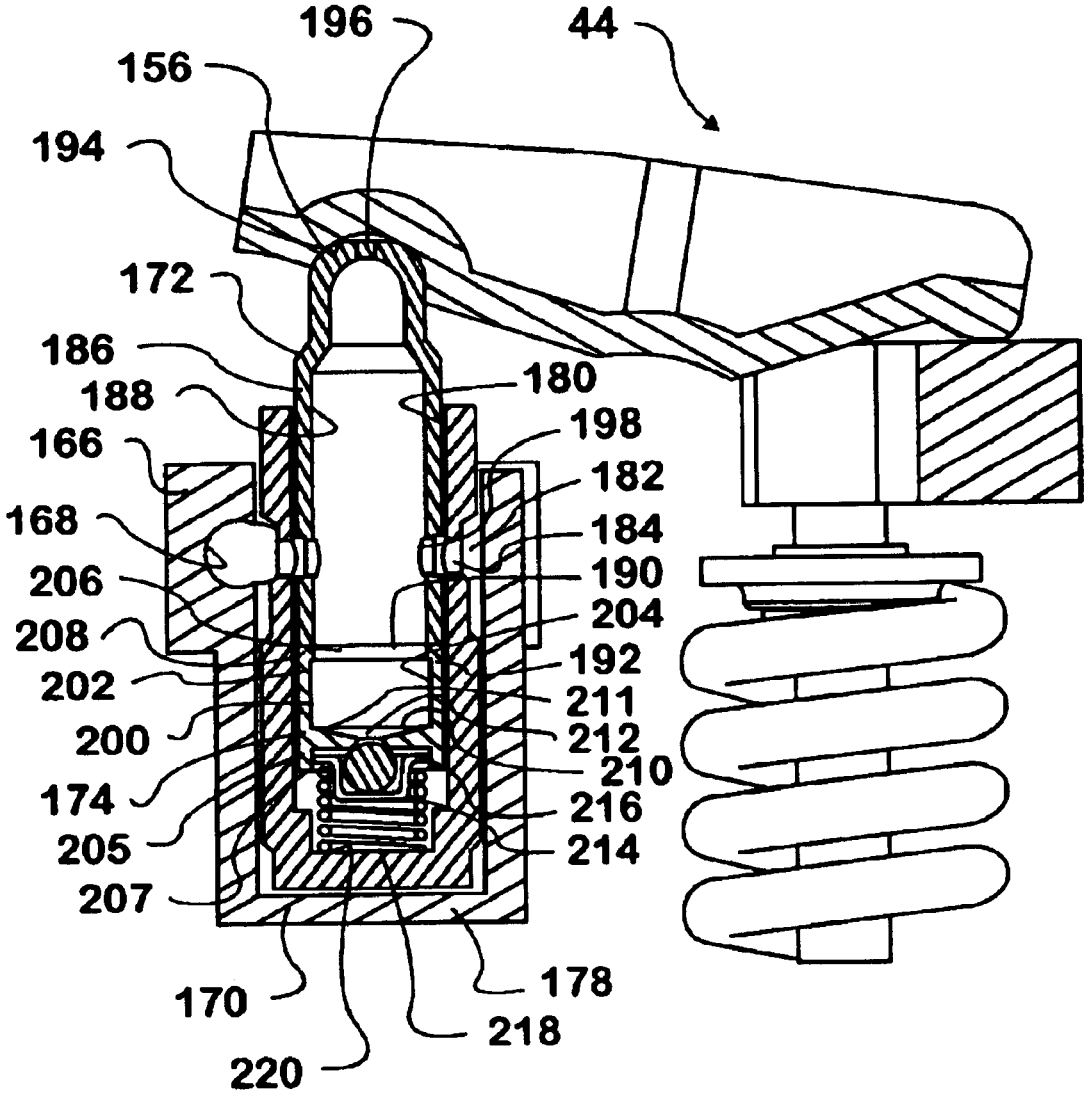
FIG. 10 is an enlarged sectional view of the UTA pivot element and lash adjuster of FIG. 9.

Details of operation of the lash adjustor 44 are now provided. Reference may be made primarily to FIGS. 9 and 10. As noted above, the downward translation of the piston 106 of the hydraulic cartridge 42 exerts a significant downward force on the pivot element 44 at the rod bearing point 158. Such force is transmitted to both the cup 156 and to the valve bearing point 160. The force felt at the cup 156 exerts a downward pressure on the piston 172 of the lash adjustor 46. This pressure translates the piston 172 and the actuator 200 slightly downward, compressing the actuating fluid in the spring well 220 to a pressure that is greater than the pressure of the actuator fluid in accumulator 168 an fluid cavity 204. The compressed actuating fluid in the spring well 220 exerts an upward bias on the ball valve 214 forcing the ball valve 214 into its closed seated disposition on the ball valve seat 212. This action effectively locks (checks) the piston 172 for the duration of the opening stroke of the engine valve 12. Once the piston 172 is locked, the interface between the domed top margin 194 of the piston 172 and the cup 156 becomes a fixed pivot point about which the pivot element 44 pivots such that all the translational motion of the piston 172 is amplified and transmitted to the engine valve 12, as noted above.

The aforementioned leakage of actuating fluid through the annulus 207 accommodates the effect of valve 12 growth due to increased operating temperatures of the engine as the engine warms from being cold at start to normal operating temperatures.

Closing of the engine valve 12 is primarily a function of the valve spring 25. The valve spring 25 closes the engine valve 12 and simultaneously exerts an upward pressure on the pivot element 44. This upward pressure on the pivot element 44 effects a rotational motion of the pivot element 44 of the cup 156. Such rotational motion acts to partially retract both the piston 106 and the needle 108 of the hydraulic cartridge 42, actuating fluid in the hydraulic cartridge 42 having been vented as noted above. The valve 12 seats several thousandths of an inch prior to seating of the piston 106 and needle 108 in the retracted disposition. When the valve 12 seats, the interface of the rod bearing point 158 and the actuation pad 22 becomes a pivot point. The pivot element 44 is now pivotable about the rod bearing point 158.

The spring 218 drives the actuator 200 and the piston 172 upward. Such translation is preferably no more than about one millimeter and is intended to take up the assembly tolerance, thermal growth of parts and wear in the valve train (e.g. engine valve seats) over the life of the engine. This translation effects a rotation of the pivot element 144 about the rod bearing point 158 and acts to seat both the piston 106 and the needle 108 in the retracted disposition. When the spring 218 lifts the actuator 200 and the piston 172, hydraulic pressure in the spring well 220 drops below the pressure of the actuating fluid in the accumulator 168 and fluid cavity 204. Responsive thereto, the ball valve 214 unseats from the ball valve seat 212 resulting in the flow of actuating fluid into the spring well 220, thereby refilling the spring well 220 to accommodate for the leakage of actuating fluid through the annulus 207 that has occurred during opening of the engine valve 12.

Figure 2:
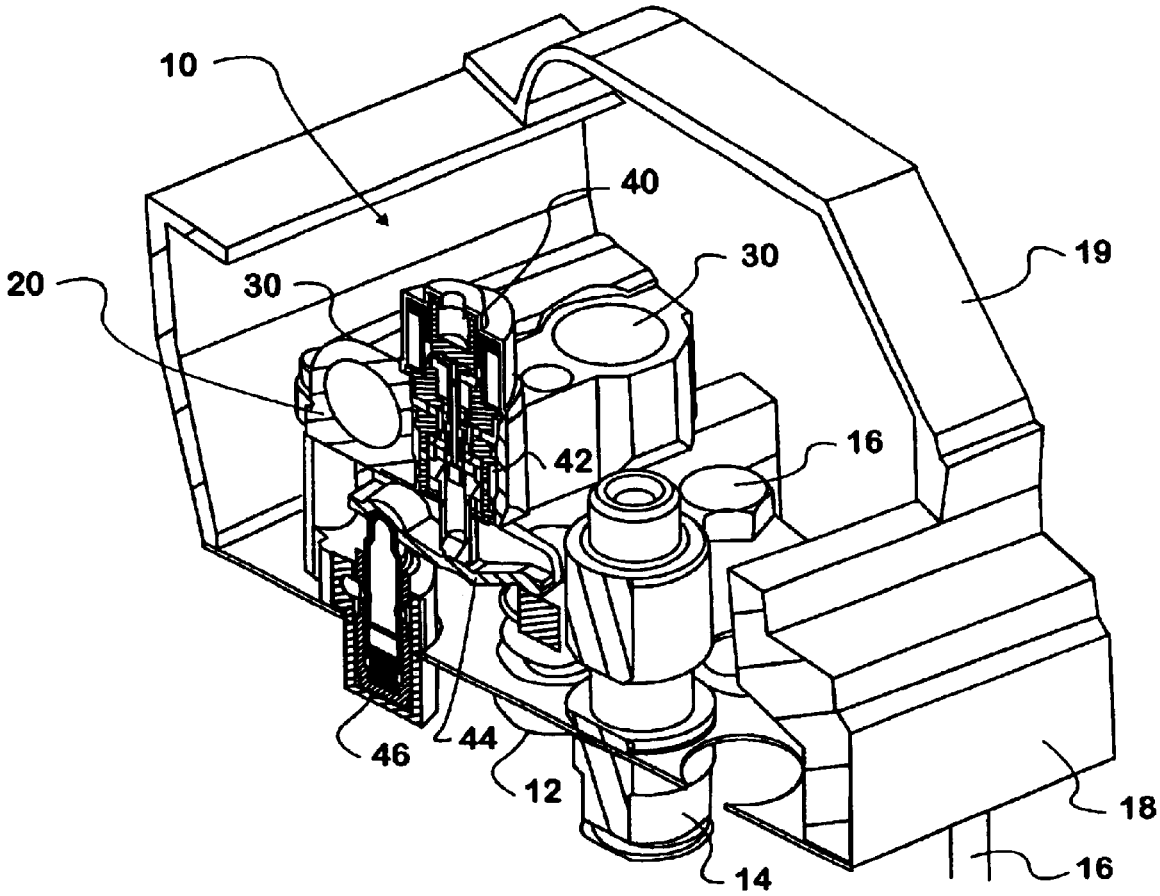
FIG. 2 is a sectional perspective view of the UTA in relation to other components in the head valve.

Referring to FIG. 2, a perspective view of the UTA 10 and other components is presented. This view underscores the fact that the arrangement packages into existing engine configurations without penalty of increasing head valve cover 19 height. Further, the injector 14 may be accessed without removing the rail 20. Additionally, the camless rail 20 may also be used to comprise the actuating fluid accumulator for the injector 14 where the injector 14 is a HEUI-type injector.

Figure 11:
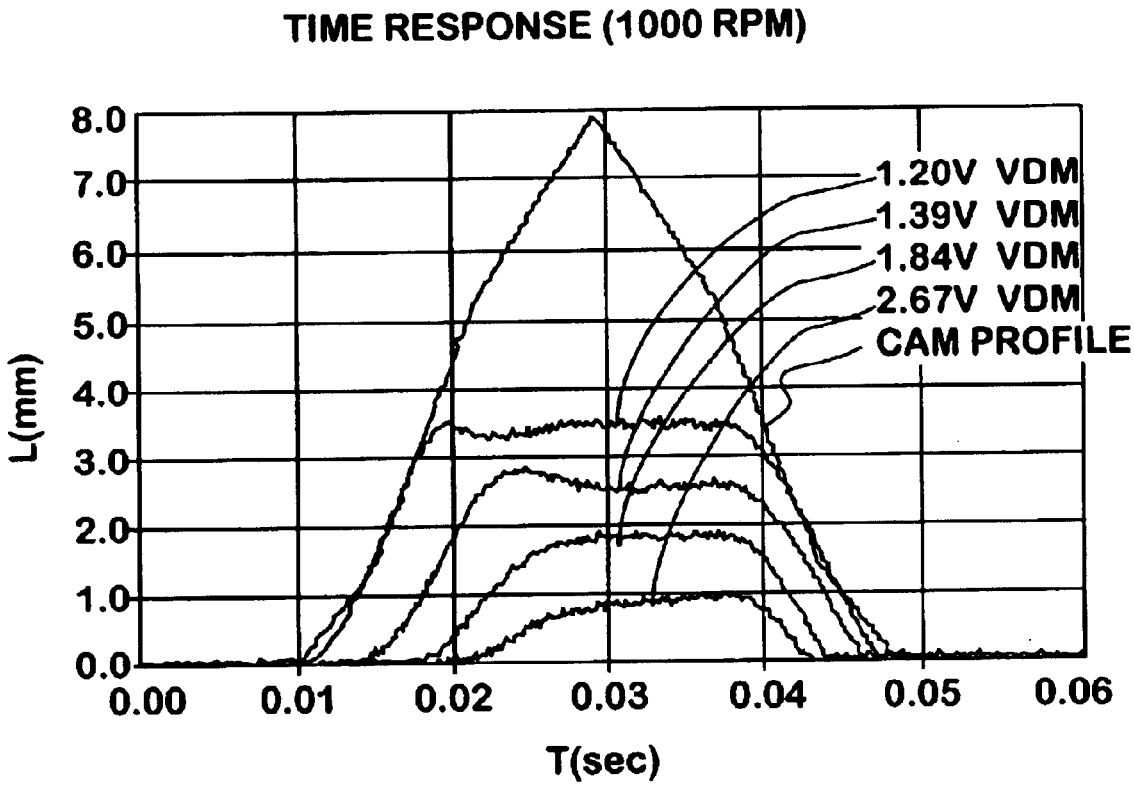
FIG. 11 is a graphic representation of UTA performance.

FIG. 11 depicts a typical control over solenoid 40. For a given engine speed, a simple calibration scheme yields various profiles including partial lift, timing, and aggressiveness of the lift enclosed motions of the engine valve 12.

Figure 12:
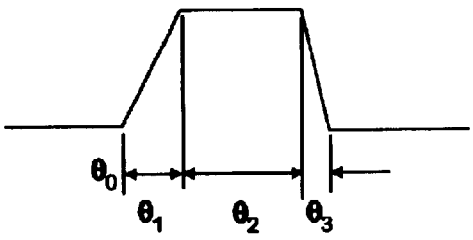
FIG. 12 is a graphic representation of the calibration method of the UTA.
Figure 12:
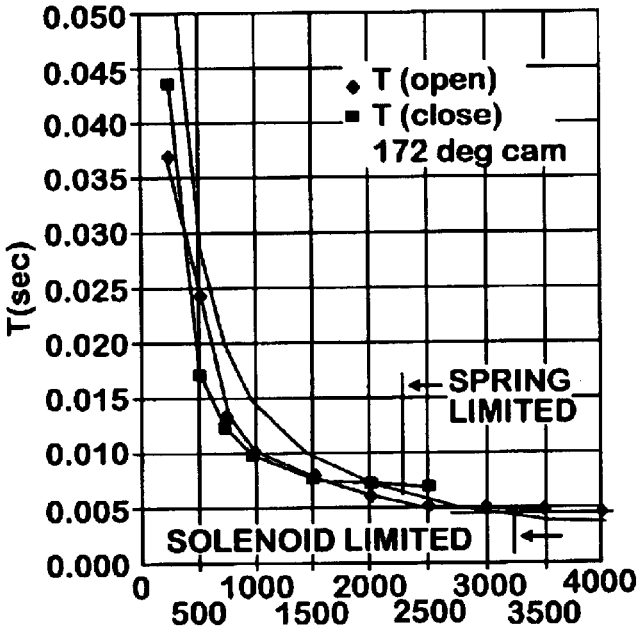

FIG. 12 is a graphic description of the calibration scheme. Timing and ramps for current build up and fall are prescribed. These parameters may be used to mimic a cam profile as shown, as well as to modulate the profile differently according to engine requirements to meet the afore stated goals for the engine.

It is obvious to those skilled in the art that other embodiments of and applications for the device and method in addition to the ones described here are indicated to be within the scope and breadth of the present application. Accordingly, the Applicant intends to be limited only by the claims appended hereto.

What is claimed is:

1. A lash adjuster comprising:

a translatable pivot element being contactable with a device having a variable amount of lash; and an actuator assembly exerting a bias on the translatable pivot element, translation of the pivot element effected thereby being variable to accommodate the variable amount of lash, the variable translation being effected by a path for continuously leaking a fluid at a known rate from the actuator during movement of the device having a variable amount of lash.

2. The lash adjuster of claim 1, the actuator being in continuous fluid communication with a low pressure fluid rail.

3. The last adjuster of claim 1, the actuator assembly having a variable volume well for holding a volume of fluid.

4. The last adjuster of claim 3, the actuator assembly well being in fluid communication with the path for leaking fluid and having a checked fluid inlet.

5. The last adjuster of claim 3, the fluid inlet being checked by a ball valve.

6. The last adjuster of claim 3, the fluid inlet being sealed by compressing a fluid in the well.

7. The lash adjuster of claim 6, the fluid in the well being compressed by subjecting the actuator assembly to a certain external force.

8. The last adjuster of claim 6, sealing of the fluid inlet acting to substantially hydraulically lock the lash adjuster.

9. The lash adjuster of claim 3, the fluid inlet being unsealed at times that the last adjuster is not subject to a certain external force.

10. The lash adjuster of claim 1, the actuator assembly having a spring disposed in a variable volume well, the spring being in a constant state of compression for exerting the bias on the translatable pivot element.

11. A method of lash adjustment comprising:

contacting a translatable pivot element with a device having a variable amount of lash;

exerting a bias on the translatable pivot element by means of an actuator assembly exerting a bias on the translatable pivot element, translation of the pivot element effected thereby being variable to accommodate the variable amount of lash; and effecting the variable translation by continuously leaking a fluid at a known rate from the actuator during movement of the device having a variable amount of lash.

12. The method of claim 11, including putting the actuator in continuous fluid communication with a low pressure of fluid rail.

13. The method of claim 11, including holding a volume of fluid in an actuator assembly variable volume well.

14. The method of claim 13, including fluid communicating the actuator assembly well with the path for leaking fluid and checking an actuator assembly well fluid inlet.

15. The method of claim 14, including checking the fluid inlet with a ball valve.

16. The method of claim 14, including scaling the fluid inlet by compressing a fluid in the well.

17. The method of claim 16, including subject the actuator assembly to a certain external force to compress the fluid in the well.

18. The method of claim 16, including substantially hydraulically locking the lash adjuster by sealing the fluid inlet.

19. The method of claim 16, including unsealing the fluid inlet at times that the lash adjuster is not subject to a certain external force.

20. The method of claim 11, including compressing an actuator assembly spring disposed in a variable volume wall in a constant state of compression and excerting the bias on the translatable pivot element by means of the spring.

21. A lash adjuster comprising:

a translatable element being contactable with a device having a variable amount of lash; and an actuator assembly exerting a bias on the translatable pivot element, translation of the element effected thereby being variable to accommodate the variable amount of lash, the variable translation being effected by a path for continuously leaking a fluid at a known rate from the actuator during movement of the device having a variable amount of lash, an actuator fluid cavity and a translatable element fluid cavity both being in continuous fluid communication with a low pressure fluid rail.

22. A method of lash adjustment, comprising:

contacting a translatable element with a device having a variable amount of lash;

exerting a bias on the translatable element by means of an actuator assembly exerting a bias on the translatable element, translation of the element effected thereby being variable to accommodate the variable amount of lash; and effecting the variable translation by continuously leaking a fluid at a known rate from the actuator during movement of the device having a variable amount of lash and putting both an actuator fluid cavity and a translation element fluid cavity in continuous fluid communication with a low pressure fluid rail.

23. A lash adjuster comprising:

a translatable pivot element being contactable with a device having a variable amount of lash; and an actuator assembly exerting a bias on the translatable element, translation of the element effected thereby being variable to accommodate the variable amount of lash, the variable translation being effected by a path for continuously leaking a fluid at a known rate from the actuator during movement of the device having a variable amount of lash, the actuator assembly being translatably disposed in a cylinder, an annulus defined between the cylinder and an actuator assembly exterior margin being the path for leaking fluid.

24. A method of lash adjustment comprising:

contacting a translatable element with a device having a variable amount of lash;

exerting a bias on the translatable element by means of an actuator assembly exerting a bias on the translatable element, translation of the element effected thereby being variable to accommodate the variable amount of lash; and effecting the variable translation by continuously leaking a fluid at a known rate from the actuator during movement of the device having a variable amount of lash, including translatably disposing the actuator assembly in a cylinder and forming the path for leaking fluid by defining an annulus between the cylinder and an actuator assembly exterior margin.

* * * * *